United States Patent [19]

Nakagawa et al.

[11] Patent Number: 4,545,334

[45] Date of Patent: Oct. 8, 1985

[54] LUBRICATING OIL COOLING SYSTEM FOR REAR OR MID ENGINED VEHICLE

[75] Inventors: Takayoshi Nakagawa; Tadao Hasegawa, both of Toyota, Japan

[73] Assignee: Toyota Jidosha Kabushiki Kaisha, Toyota, Japan

[21] Appl. No.: 605,822

[22] Filed: May 1, 1984

[30] Foreign Application Priority Data

Oct. 14, 1983 [JP] Japan ..... 58-192224

[51] Int. Cl.[4] ..... F01P 11/08

[52] U.S. Cl. ..... 123/41.33; 123/196 AB; 74/606 A; 165/154

[58] Field of Search ..... 123/41.33, 41.31, 41.51, 123/196 AB, 196 R; 165/154; 74/606 A

[56] References Cited

U.S. PATENT DOCUMENTS

| | | | |
|---|---|---|---|
| 2,446,995 | 8/1948 | Bay | 123/41.33 |
| 2,729,203 | 1/1956 | Prendergast | 123/41.33 |
| 3,080,857 | 3/1963 | Middendorf | 1233/41.51 |
| 3,486,488 | 12/1969 | Frings | 123/41.51 |
| 3,874,183 | 4/1975 | Tabet | 74/606 A |
| 4,167,969 | 9/1979 | Ritzenthaler | 123/41.33 |
| 4,392,526 | 7/1983 | Hage et al. | 165/154 |

*Primary Examiner*—E. Rollins Cross

*Attorney, Agent, or Firm*—Oblon, Fisher, Spivak, McClelland & Maier

[57] ABSTRACT

In a rear engined or mid engined type of automotive vehicle in which a liquid cooled internal combustion engine is mounted at least partly behind a passenger compartment, and a radiator for cooling the cooling fluid of the engine is mounted in front of the passenger compartment, with a mechanism being provided for conducting flow of cooling fluid between the cooling fluid jacket of the engine and the radiator in both directions, a cooling system for lubricating oil of the engine includes a heat exchanger formed with a cooling fluid passage and a lubricating oil passage arranged to exchange heat therebetween to conduct respectively a flow of cooling fluid and a flow of lubricating oil from the internal combustion engine, wherein the cooling fluid passage of the heat exchanger is a part of the cooling fluid flow conducting mechanism, so as not to the heat exchanger without substantially increasing the flow resistance of the cooling fluid flow conducting mechanism. Optionally, the cooling fluid passage and the lubricating oil passage of the heat exchanger may be provided by a plurality of coaxially arranged cylinders wherein the cooling fluid and the lubricating oil flowing axially through the respective cylindrical passages are brought into mutual heat exchange across a cylindrical heat conducting separating wall.

8 Claims, 5 Drawing Figures

LUBRICATING OIL COOLING SYSTEM FOR REAR OR MID ENGINED VEHICLE

BACKGROUND OF THE INVENTION

The present invention relates to a lubricating oil cooling system for a liquid cooled internal combustion engine incorporated in an automotive vehicle such as a passenger car, and more particularly relates to such a lubricating oil cooling system which is suitable for utilization in an automotive vehicle which has its liquid cooled internal combustion engine located behind at least part of the passenger compartment of said vehicle, as, for example, a rear engined or mid engined passenger automobile.

Rear engined and mid engined automobiles are becoming relatively popular in recent times. In these rear and mid engined automobiles, certain problems arise with respect to provision of adequate cooling for the lubricant oil in the engine, because the considerable draft of air caused by the relative wind due to the forward motion of the vehicle does not give such a high cooling effect to the engine, particularly to the lower parts of the engine where the lubricating oil pan is located as in the front engined automobiles. Accordingly there is a risk that the temperature of the lubricating oil should rise so high as to reach an undesirably high value which can cause loss of lubricating quality of the lubricating oil and breakdown of the proper film of lubricating oil required to keep the relatively moving parts of the engine separated and functioning smoothly without undue friction.

As a device for restricting the rise in temperature of the lubricating oil of the internal combustion engine in a rear engined or mid engined automotive vehicle, a per se well known lubricating oil cooling device commonly called a heat exchanger or oil cooler might be considered for application. Now, in the case of a rear engined or mid engined automotive vehicle, the application of an air cooled heat exchanger is not suitable, because as explained above no strong air current will be available unless such an air cooled heat exchanger is provided at the front end portion of the vehicle, but it is undesirable for the lubricating oil passages to be so very long as would be required if such an air cooled heat exchanger were mounted at the front end of the vehicle to receive the impact of a strong draft thereupon. Thus, in the case of such a vehicle, it is desirable to use a a cooling fluid cooled type of heat exchanger for the lubricating oil, provided that the engine is of a cooling fluid cooled type.

However, in the design of the circulation system for the cooling fluid of such a rear engined or mid engined automotive vehicle, problems also arise with regard to minimizing the flow resistance thereof, since inevitably the cooling fluid passage system leading heated cooling fluid from the internal combustion engine to the radiator, and leading cooled cooling fluid back from the radiator to the internal combustion engine, is required to be considerably long, since the radiator is required to be at the front end of the vehicle so as to receive a good draft of air. These problems can be overcome; but the incorporation of a conventional type of cooling fluid cooled heat exchanger for the lubricating oil in such a construction gives rise to additional problems with regard to increasing the flow resistance of the cooling fluid passage system. Accordingly, the integration of such a lubricating oil heat exchanger into the cooling system of a rear engined or mid engined vehicle requires an inventive development.

SUMMARY OF THE INVENTION

Accordingly, it is the primary object of the present invention to provide a lubricating oil cooling system which is suitable for incorporation into a rear engined or mid engined automotive vehicle in which the internal combustion engine is cooled by flow of cooling fluid therethrough.

It is a further object of the present invention to provide such a lubricating oil cooling system for such an automotive vehicle, which minimizes problems associated with flow resistance of the cooling fluid conduits between the internal combustion engine and the radiator of the vehicle.

It is a further object of the present invention to provide such a lubricating oil cooling system for such an automotive vehicle, which keeps the lubricating oil of the internal combustion engine at a desirably low temperature without giving rise to problems with regard to circulation of the cooling fluid of the internal combustion engine.

It is a yet further object of the present invention to provide such a lubricating oil cooling system for such an automotive vehicle, which can achieve the above mentioned objects while minimizing the associated complexity thereof, weight, and number of parts.

It is a yet further object of the present invention to provide such a lubricating oil cooling system for such an automotive vehicle, which provides cooling for the lubricating oil of the internal combustion engine only when really necessary.

According to the most general aspect of the present invention, these and other objects are accomplished for a vehicle having a passenger compartment and a liquid cooled internal combustion engine mounted at least partly behind said passenger compartment with regard to the forward moving direction of said vehicle, by providing a lubricating oil system comprising a cooling fluid jacket for circulation of cooling fluid therethrough for cooling said internal combustion engine; a radiator for cooling cooling fluid mounted in front of said passenger compartment with regard to the forward moving direction of said vehicle; and means for conducting flow of cooling fluid between said cooling fluid jacket of said internal combustion engine and said radiator in both directions: a cooling system for lubricating oil of said internal combustion engine, comprising: a heat exchanger formed with a cooling fluid passage and a lubricating oil passage arranged to exchange heat therebetween, lubricating oil of said internal combustion engine flowing through said lubricating oil passage and the cooling fluid for cooling said internal combustion engine flowing through said cooling fluid passage; said cooling fluid passage of said heat exchanger being a part of said cooling fluid flow conducting means.

According to such a structure, it is possible to effectively cool the lubricating oil of the internal combustion engine by the flow of the cooling fluid of the engine which is anyway passing through the cooling fluid flow conducting means in order to be circulated between the engine and the radiator; and thereby the length of the cooling fluid flow conducting means is not required to be particularly extended to any more than its already necessary length in order to fit the heat exchanger for lubricating oil to the vehicle, thus avoiding a situation where the flow resistance of the cooling fluid conduits between the engine and the radiator becomes unduly high, and avoiding problems arising with regard to circulation of the cooling fluid of the internal combustion engine, as well as minimizing the associated complexity thereof, weight, and number of parts.

Further, according to a more particular aspect of the present invention, these and other objects are more particularly and concretely accomplished by a lubricating oil cooling system as described above, wherein said cooling fluid passage of said heat exchanger forms a portion a part of said cooling fluid flow conducting means which conducts a flow of cooling fluid from said cooling fluid jacket of said engine towards said radiator.

According to such a structure, the heat picked up by this cooling fluid which has cooled the lubricating oil in the heat exchanger is then dissipated in the radiator of the vehicle, and is not undesirably returned to the engine. This ensures that the temperature of the cooling fluid flowing through the cooling fluid jacket of the engine is kept at a proper level.

Further, according to another more particular aspect of the present invention, these and other objects are more particularly accomplished by a lubricating oil cooling system of either of the types described above, wherein the direction of fluid flow through said cooling fluid passage of said heat exchanger is generally opposite to the direction of fluid flow through said lubricating oil passage of said heat exchanger.

According to such a structure, the effectiveness of heat exchange between the cooling fluid flowing in the cooling fluid passage of the heat exchanger and the lubricating oil flowing in the lubricating oil passage thereof is maximized.

Further, according to a yet more particular aspect of the present invention, these and other objects are more particularly accomplished by a lubricating oil cooling system as first described above, wherein said heat exchanger is constructed with said cooling fluid passage and said lubricating oil passage being coaxial cylinders one inside the other.

According to such a structure, a long heat interchange portion can be provided between the cooling fluid passage and the lubricating oil passage, with minimum increase of flow resistance to both the flow of cooling fluid and the flow of lubricating oil.

Further, according to yet another more particular aspect of the present invention, these and other objects are more particularly accomplished by a lubricating oil cooling system as first described above, wherein said internal combustion engine comprises a lubricating oil pump and a relief valve which feeds lubricating oil to said lubricating oil passage of said heat exchanger when the pressure delivered by said pump becomes greater than a predetermined pressure value.

According to such a structure, lubricating oil is only fed to said heat exchanger to be cooled in those circumstances in which the internal combustion engine is rotating quickly so that the lubricating oil pump thereof is delivering a high output pressure so as to cause relief lubricating oil to be supplied by said relief valve, and since these are the type of circumstances in which there is a strong risk of the lubricating oil of the engine overheating, this method of operation provides cooling for the lubricating oil of the engine just when it is required. Further, since according to this particular specialization of the present invention only the relief or blowoff lubricating oil is cooled, the operation of cooling the lubricating oil has no substantial effect on the lubricating oil pressure of the engine either to raise it or to lower it, which is appropriate in view of the desirability of restricting fluctuations of the lubricating oil pressure of the engine.

Further, according to a yet more particular aspect of the present invention, these and other objects are more particularly and concretely accomplished by a lubricating oil cooling system as proximately described above, wherein said internal combustion engine comprises a second relief valve which vents lubricating oil not to supply lubricating oil towards said lubricating oil passage of said heat exchanger when the pressure delivered by said pump becomes greater than a threshold pressure value which is substantially higher than said predetermined pressure value.

According to such a structure, a backup relief function is assured for preventing the lubricating oil pressure of the internal combustion engine rising above said threshold pressure value. This is important because flow resistance of the lubricating oil passage of the heat exchanger might otherwise undesirably deteriorate the venting function of the first relief valve.

Further, according to another yet more particular aspect of the present invention, these and other objects are more particularly and concretely accomplished by a lubricating oil cooling system as first described above, said vehicle further comprising a transmission, further comprising a cooling system for lubricating oil of said transmission, comprising: a second heat exchanger formed with a cooling fluid passage and a lubricating oil passage arranged to exchange heat therebetween, the lubricating oil of said transmission flowing through said lubricating oil passage and the cooling fluid flowing through said cooling fluid passage; said cooling fluid passage of said second heat exchanger being a part of said cooling fluid flow conducting means.

According to such a structure, also the lubricating oil of the transmission is cooled, in a similar manner to that described above. In this case, it may be that said cooling fluid passage of said first heat exchanger is a part of a part of said cooling fluid flow conducting means which conducts a flow of cooling fluid from said cooling fluid jacket of said internal combustion engine towards said radiator, and said cooling fluid passage of said second heat exchanger is a portion of a part of said cooling fluid flow conducting means which conducts a flow of cooling fluid from said radiator towards said cooling fluid jacket of said internal combustion engine. This will not cause any problem with regard to heating of the cooling fluid flowing into the cooling fluid jacket of the internal combustion engine, because typically the amount of heat required to be dissipated from the lubricating oil of the transmission is relatively small.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DETAILED DESCRIPTION OF THE PREFERRED EMBODIMENT

Figure 1:
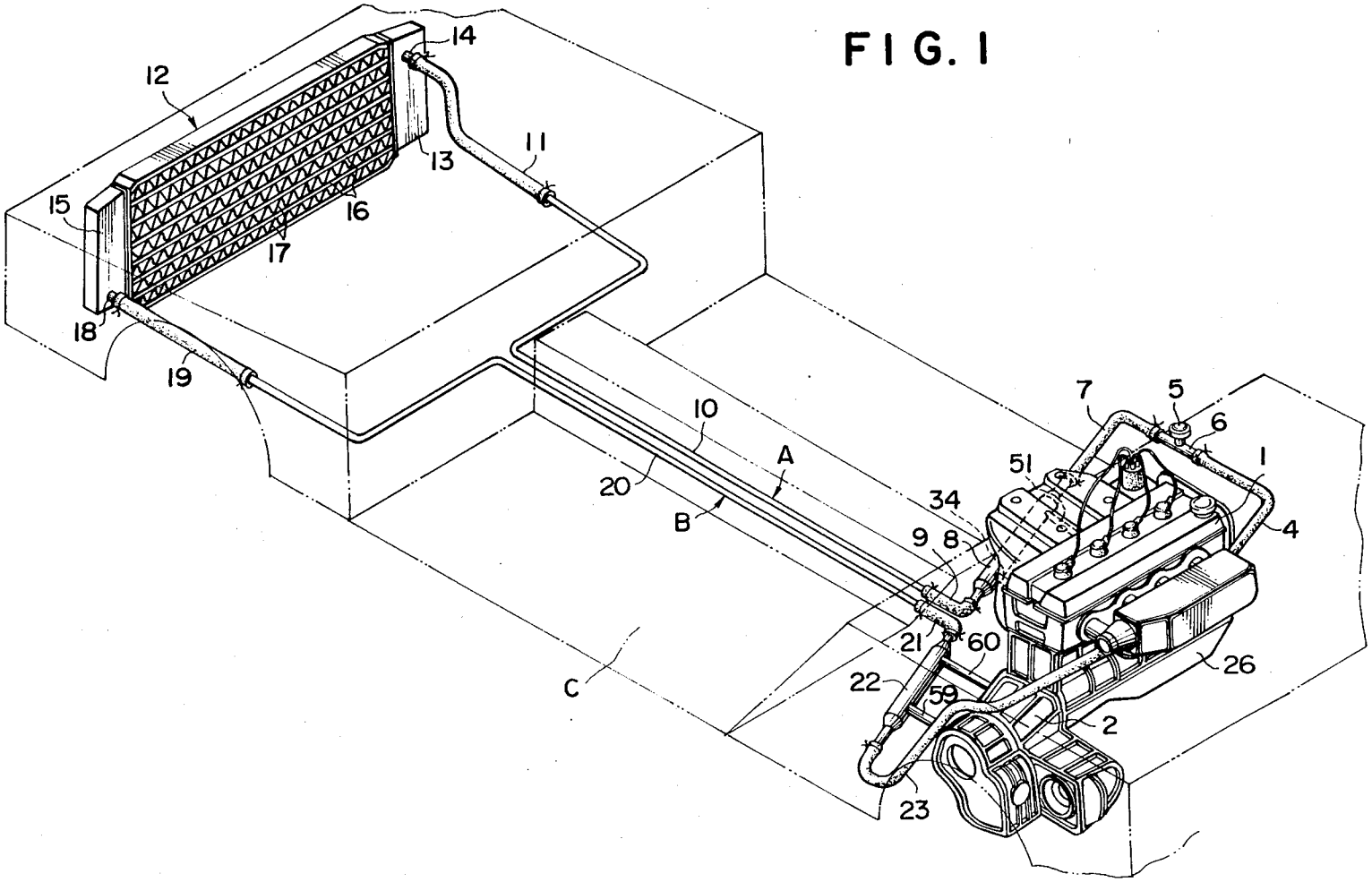
FIG. 1 is a part phantom schematic perspective view of the body of an automotive vehicle and an internal combustion engine and a transmission unit incorporated therein along with various other parts thereof, said vehicle incorporating a lubricating oil cooling system according to the preferred embodiment of the present invention.

The present invention will now be described with reference to the preferred embodiment thereof, and with reference to the appended drawings. Referring to FIG. 1, the body of the automotive vehicle is partly shown in phantom form by the double dotted lines, and the passenger compartment thereof is schematically indicated by the symbol "C". This automotive vehicle is of the previously described type with its engine and transmission unit mounted in the rear of its body behind the passenger compartment C with the central axis of said engine and transmission unit extending transversely to the longitudinal axis of the vehicle, and with its radiator mounted in the front of its body before the passenger compartment C.

In more detail, the automotive vehicle incorporates a liquid cooled internal combustion engine, denoted by the reference numeral 1, and a transaxle unit denoted by the reference numeral 2 which is secured to the engine 1 and which comprises a per se well known automatic transmission unit and a differential device; and this combination of the engine 1 and the transaxle unit 2 is transversely mounted in the vehicle body behind the passenger compartment C (the front of the vehicle is to the left in FIG. 1), the transaxle unit of course being drivingly connected to the rear wheels, not shown, of the vehicle, via drive shafts also not shown.

Figure 2:
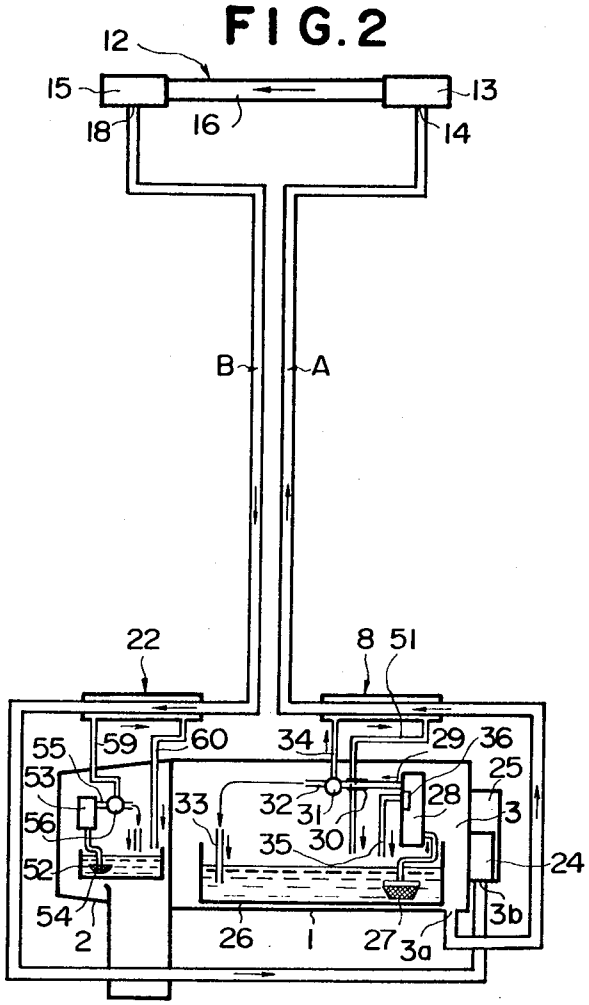
FIG. 2 is a schematic sectional view of said internal combustion engine and said transaxle unit and of various parts of the cooling system therefor.

Referring to FIG. 2 in particular, which includes a schematic sectional view of said liquid cooled internal combustion engine 1 and said transaxle unit 2 and of various parts of the cooling system therefor, the internal combustion engine 1 has a cooling fluid jacket 3 which is defined in the cylinder block and the cylinder head thereof and which generally surrounds the cylinders and the cylinder chambers thereof (not particularly shown), and during operation of the vehicle this cooling fluid jacket 3 is filled with cooling fluid such as a water and antifreeze mixture which absorbs heat generated in said cylinders and cylinder chambers by the operation of the internal combustion engine 1 in a per se well known fashion. This cooling fluid jacket 3 has a cooling fluid outlet 3*a* and a cooling fluid inlet, and a cooling fluid pump 25 of a per se well known sort, which has a cooling fluid inlet and a cooling fluid outlet which is communicated directly to said cooling fluid inlet of said cooling fluid jacket 3, is driven by the rotation of the internal combustion engine 1 and pumps cooling fluid from its cooling fluid inlet into the cooling fluid jacket 3, said cooling fluid after having been heated in the cooling fluid jacket 3 then passing out of the cooling fluid outlet 3*a* thereof, as schematically indicated by the arrows in the figure. The cooling fluid inlet of the cooling fluid pump 25 is communicated to the cooling fluid outlet of a per se well known temperature sensitive valve 24, which has a cooling fluid inlet 3*b*. This temperature sensitive valve (or thermostat) 24 is so arranged as to open, i.e. to communicate its cooling fluid inlet 3*b* to its cooling fluid outlet, when the temperature of the cooling fluid is greater than a certain predetermined threshold temperature value, and to close, i.e. to discommunicate its cooling fluid inlet 3*b* from its cooling fluid outlet, when the temperature of the cooling fluid is less than said predetermined threshold temperature value. The internal combustion engine 1 also has a bypass passage (not shown) of a restricted size which directly communicates the cooling fluid inlet 3*b* of the temperature sensitive valve 24 to the cooling fluid inlet of the cooling fluid pump 25.

In the front end of the automotive vehicle before the passenger compartment C there is mounted a radiator 12, which is constructed in this particular application of the present invention as a side flow type with two side tanks 13 and 15 and with a plurality of substantially horizontal tubes 16 connecting together these side tanks 13 and 15, the radiator 12 being mounted so that these horizontal tubes 16 extend transversely to the longitudinal axis of the vehicle. A plurality of cooling fins 17 are mounted between the tubes 16 for providing good cooling therefor, and the radiator 12 is vertically mounted, so that the relative wind due to the motion of the vehicle relative to the air impinges on the front side of the radiator and blows between the tubes 16 and the fins 17. The inlet side tank 13 has a cooling fluid inlet 14 at its upper portion, and the outlet side tank 15 has a cooling fluid outlet 18 at its lower portion.

The cooling fluid outlet 3*a* of the cooling fluid jacket 3 of the engine 1 is connected to the cooling fluid inlet 14 of the side tank 13 of the radiator 12 via a first cooling fluid passage construction A, and the cooling fluid inlet 3*b* of the temperature sensitive valve 24 is connected to the cooling fluid outlet 18 of the other side tank 15 of the radiator 12 via a second cooling fluid passage construction B. These cooling fluid passage constructions A and B run under the passenger compartment C of the vehicle in a protected tunnel shape formed on the floor thereof and only schematically shown in the figure.

With regard to the details of these cooling fluid passage constructions A and B, which are shown in detail in FIG. 1 but are not completely shown in FIG. 2, the first cooling fluid passage construction A comprises, in order in the direction of cooling fluid flow therealong, a first rubber hose member 4 the upstream end of which is connected to the cooling fluid outlet 3*a* of the cooling fluid jacket 3, a cooling fluid supplying member 6 the upstream end of which is connected to the downstream end of the first rubber hose member 4 and which incorporates an inlet 5 for addition of cooling fluid when so required, a second rubber hose member 7 the upstream end of which is connected to the downstream end of the cooling fluid supplying member 5, a first heat exchanger 8 for cooling the lubricating oil of the internal combustion engine 1 which will be explained in detail later and the upstream cooling fluid inlet end of which is connected to the downstream end of the second rubber hose member 7, a third rubber hose member 9 the upstream end of which is connected to the downstream cooling fluid outlet end of the first heat exchanger 8, a first long metallic tube 10 the upstream end of which is connected to the downstream end of the third rubber hose member 9 and which extends through the aforesaid protected tunnel shape formed on the floor of the passenger compartment C of the vehicle, and a fourth rubber hose member 11 the upstream end of which is connected to the downstream end of the first long metallic tube 10 and the downstream end of which is connected to the cooling fluid inlet 14 of the side tank 13 of the radiator 12. On the other hand, the second cooling fluid passage construction B comprises, also in order in the direction of cooling fluid flow therealong, a fifth rubber hose member 19 the upstream end of which is connected to the cooling fluid outlet 18 of the side tank 15 of the radiator 12, a second long metallic tube 20 the upstream end of which is connected to the downstream end of said fifth rubber hose member 19 and which also extends parallel to and alongside the first long metallic tube 10 through the aforesaid protected tunnel shape formed on the floor of the passenger compartment C of the vehicle, a sixth rubber hose member 21 the upstream end of which is connected to the downstream end of said second long metallic tube 20, a second heat exchanger 22 for cooling the lubricating oil or working fluid of the transaxle device 2 which will be explained in detail later and the upstream cooling fluid inlet end of which is connected to the downstream end of said sixth rubber hose member 21, and a seventh rubber hose member 23 the upstream end of which is connected to the downstream cooling fluid outlet end of said second heat exchanger 22 and the downstream end of which is connected to the cooling fluid inlet 3*b* of the temperature sensitive valve 24. Thus, particularly according to the present invention, the first heat exchanger 8 is provided directly in the flow path of cooling fluid from the liquid cooled internal combustion engine 1 at the rear of the automotive vehicle to the radiator 12 at the front of the vehicle, with no particular special auxiliary conduits being required for the conduction of cooling fluid to said first heat exchanger 8; and also particularly according to the present invention the second heat exchanger 22 is similarly provided directly in the flow path of cooling fluid from the radiator 12 at the front of the vehicle to the liquid cooled internal combustion engine 1 at the rear of the automotive vehicle, with no particular special auxiliary conduits being required for the conduction of cooling fluid to said second heat exchanger 22.

The internal combustion engine 1 comprises a lubricating oil pan 26 which serves as a reservoir for a pool of lubricating oil used by said engine 1, and lubricating oil is sucked up from said pool by a lubricating oil pump 28 via a strainer 27 and is pressurized in a conventional fashion, to be then supplied to a lubricating oil conduit 30 which leads to a first relief valve 31, which may be of a conventional spring type. After passing through the first relief valve 31, this pressurized lubricating oil is then supplied via another lubricating oil conduit 32 to various parts of the internal combustion engine 1 which are to be lubricated and cooled such as valve driving mechanisms and crankshaft bearings and so on which are not particularly shown in the figures but are schematically indicated by an arrow. From these lubricated and cooled mechanisms, the used lubricating oil is returned via a lubricating oil conduit 33 and is drained back to the lubricating oil pool in the lubricating oil pan 26. When the lubricating oil pressure at the first relief valve 31 starts to rise up to be higher than a certain first predetermined pressure value, then a sufficient flow of lubricating oil is released by this first relief valve 31 to a relief lubricating oil conduit 34 to bring the lubricating oil pressure down to said certain first predetermined pressure value. This relief lubricating oil conduit 34, as will be explained in detail shortly, conducts this relief lubricating oil flow to the lubricating oil path of the first heat exchanger 8, so as to cool said relief lubricating oil flow by exchanging some of its heat to the cooling fluid flowing through the cooling fluid flow path of said first heat exchanger 8, before said relief lubricating oil is returned to the lubricating oil pool in the lubricating oil pan 26 via a drain conduit 51.

In the shown construction, additionally the lubricating oil pump 28 incorporates a second relief valve 36, which is preset to open at a certain second predetermined pressure value which is substantially higher than the predetermined first pressure value relating to the first relief valve 31, so as then to vent a relief flow of lubricating oil to the lubricating oil pool in the lubricating oil pan 26 via a conduit 35. The reason for the provision of this second relief valve is as follows. If the pressure of the lubricating oil output from the lubricating oil pump 28 tries to rise above said first predetermined value, as explained above the first relief valve 31 allows some flow of lubricating oil to escape to the relief lubricating oil conduit 34 so as to limit the lubricating oil pressure at said first relief valve 31 to be substantially equal to said first predetermined lubricating oil pressure value; but this action is only effective, so long as this relief lubricating oil conduit 34 can accept this relief lubricating oil flow. Now, because as will be seen from the following the first heat exchanger 8 has a by no means negligible flow resistance, if this relief flow of lubricating oil is thus required to become too great, as when the revolution speed of the internal combustion engine 1 becomes very high, there is a risk that this flow cannot be pushed through the first heat exchanger 8 by the pressure available to do so; and in such a case the output pressure in the lubricating oil conduit 32 of the lubricating oil supplied to lubricate and cool the parts of the internal combustion engine 1 would undesirably rise. However, this rise of the pressure in the lubricating oil conduit 32 is effectively stemmed by the provision of the second relief valve 36, which does not allow said pressure to rise to greater than said second predetermined value: the difficulty relating to the first relief valve described above does not apply to this second relief valve 36, because the relief lubricating oil path (incorporating the conduit 35) from this second relief valve 36 has no very substantial flow resistance.

Similarly, the transaxle device 2 comprises a lubricating oil pan 52 which serves as a reservoir for a pool of lubricating oil or working fluid (which will hereinafter be referred to as lubricating oil, since it partakes of the characteristics thereof) used by said transaxle device 2, and lubricating oil is sucked up from said pool by a lubricating oil pump 53 via a strainer 54 and is pressurized in a conventional fashion, to be then supplied to a lubricating oil conduit 55 which leads to a relief valve (or line lubricating oil pressure control valve) 56, which again may be of a conventional spring type. After passing through said relief valve 56, this pressurized lubricating oil is then supplied via another lubricating oil conduit to various parts of the transaxle device 2 which are to be supplied with lubricating oil, such as a torque converter and gear systems and a hydraulic fluid pressure control device and so on which are not particularly shown in the figures but are schematically indicated by an arrow. From these various mechanisms, the used lubricating oil is returned via a lubricating oil conduit and is drained back to the lubricating oil pool in the lubricating oil pan 52. When the lubricating oil pressure at the relief valve 56 starts to rise up to be higher than a certain third predetermined pressure value, then a sufficient flow of lubricating oil is released by this relief valve 56 to a relief lubricating oil conduit 59 to bring the lubricating oil pressure down to said certain third predetermined pressure value. This relief lubricating oil conduit 59, as will be explained in detail shortly, conducts this relief lubricating oil flow to the lubricating oil path of the second heat exchanger 22, so as to cool said relief lubricating oil flow by exchanging some of its heat to the cooling fluid flowing through the cooling fluid flow path of said second heat exchanger 22, before it is returned to the oil pool in the lubricating oil pan 52 via a drain conduit 60.

Figure 3:
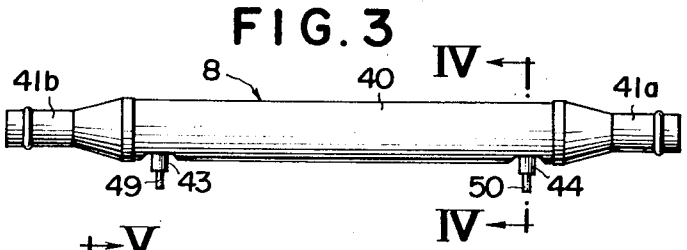
FIG. 3 is a plan view of a first heat exchanger included in said lubricating oil cooling system according to the present invention.
Figure 4:
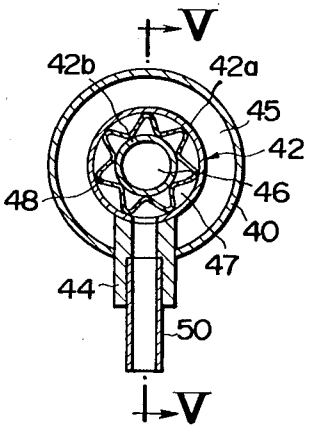
FIG. 4 is a transverse sectional view of this first heat exchanger taken in a plane perpendicular to the central longitudinal axis thereof and indicated by the arrows IV—IV in FIG. 3.
Figure 5:
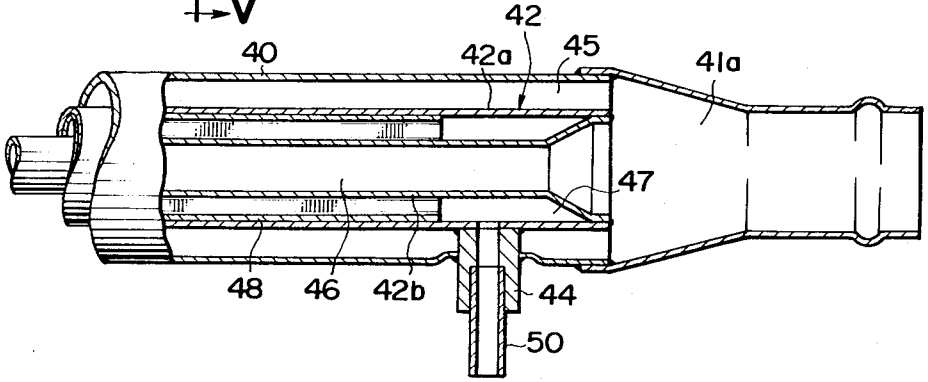
FIG. 5 is a longitudinal sectional view of this first heat exchanger taken in a plane containing to the central longitudinal axis thereof and indicated by the arrows V—V in FIG. 4.

Now the construction of the first heat exchanger 8, in this preferred embodiment, will be described. FIG. 3 is a plan view of said first heat exchanger 8, and shows that it comprises an outer tube or body member 40 with two conical cap shaped end members: a cooling fluid inlet member 41*a* formed with a cooling fluid inlet aperture at its apex and mounted at the right end in the figure of said outer tube member 40, and a cooling fluid outlet member 41*b* similarly formed with a cooling fluid outlet aperture at its apex and mounted at the left end in the figure of said outer body tube member 40. The internal details of said first heat exchanger 8 can be seen in FIGS. 4 and 5: FIG. 4 is a transverse sectional view of this first heat exchanger 8 taken in a plane perpendicular to the central longitudinal axis thereof and indicated by the arrows IV—IV in FIG. 3, and FIG. 5 is a longitudinal sectional view of this first heat exchanger 8 taken in a plane containing to the central longitudinal axis thereof and indicated by the arrows V—V in FIG. 4. As can be seen from these figures, within the outer body tube member 40 there is coaxially provided an inner double walled tube assembly 42, which comprises an intermediate tube member 42*a* and an inner tube member 42*b* mounted coaxially therein. The inner tube member 42*b* is fixedly supported within the outer tube member 42*a* by end caps shaped as conical members (only one of which can be seen in the figures) and also by a crinkled or wavy radiation fin member 48 which is shaped as an elongated member creased in its longitudinal direction so that its outer surface touches the inside surface of the outer tube member 42*a* along a plurality of generatrices thereof while its inner surface touches the outside surface of the inner tube member 42*b* likewise along a plurality of generatrices thereof. Thus, considering the inner tube assembly 42 only, it defines an inner cylindrical space 46 open at both its ends to the outside of said assembly 42, and, surrounding said inner cylindrical space 46, an outer hollow cylindrical shaped space 47 closed at both its ends between the inside surface of the outer tube member 42*a* and the outside surface of the inner tube member 42*b*. The inner tube member 42*b* is fixedly supported within the outer tube member 42*a* by a lubricating oil inlet member 43 and a lubricating oil outlet member 44, both of which are shaped as short tubes which extend in generally radial directions from the outside inwards through apertures formed in the material of the outer tube member 40 at its opposite ends, being fixed in a liquid tight fashion to the peripheries of said apertures, with their ends being fixed to the outside surface of the outer tube member 42*a* and with their interior holes being communicated to the respective ends of the hollow cylindrical shaped space 47 defined between the inside surface of the outer tube member 42*a* and the outside surface of the inner tube member 42*b*. Thereby, around the hollow cylindrical shaped space 47, another hollow cylindrical shaped space 45 is defined between the inside surface of the outer body tube member 40 and the outside surface of the outer tube member 42*a*, open at its both ends to the respective end cap members 41*a* and 41*b*, as is the inner cylindrical space 46.

Inlet and outlet mounting pipe members 49 and 50 are respectively provided as fitted into the holes of the lubricating oil inlet member 43 and the lubricating oil outlet member 44, and the inlet mounting pipe member 49 is connected to the relief lubricating oil conduit 34, previously mentioned as leading from the first lubricating oil relief valve 31 for the lubricating oil which lubricates the internal combustion engine 1, while the outlet mounting pipe member 50 is connected to the drain lubricating oil conduit 51, previously mentioned as leading to the lubricating oil pan 26 of the internal combustion engine 1 to drain cooled lubricating oil thereto. Particularly according to a particular specialization of the present invention, the lubricating oil inlet mounting pipe member 49 is provided at that end of the first heat exchanger 8 at which cooling fluid is fed out, i.e. at the end thereof at which the cooling fluid outlet member 41*b* (which is connected to the upstream end of the third rubber hose member 9) is provided, and the lubricating oil outlet mounting pipe member 50 is provided at that end of the first heat exchanger 8 at which cooling fluid is fed in, i.e. at the end thereof at which the cooling fluid inlet member 41*a* (which is connected to the downstream end of the second rubber hose member 7) is provided. Thus, in the first heat exchanger 8, during operation of the lubricating oil cooling system according to the preferred embodiment of the present invention, the directions of the flows of cooling fluid and of lubricating oil are opposite with the reason for this being explained later.

The second heat exchanger 22 is made in a similar fashion to the first heat exchanger 8, and accordingly details of its interior construction will be omitted for the sake of brevity of explanation. Its inlet mounting pipe member is connected to the relief lubricating oil conduit 59 of the transaxle device 2, previously mentioned as leading from the second lubricating oil relief valve 56 for the lubricating oil which lubricates the transaxle device 2, while its outlet mounting pipe member is connected to the drain lubricating oil conduit 60, previously mentioned as leading to the lubricating oil pan 52 of the transaxle device 2 to drain cooled lubricating oil thereto. It is important to note that, similarly to the case with the first heat exchanger 8 as explained above, the lubricating oil inlet mounting pipe member of the second heat exchangers 22 is provided at that end thereof at which cooling fluid is fed out, i.e. at the end thereof to which the upstream end of the seventh rubber hose member 23 is connected, and the lubricating oil outlet mounting pipe member of the second heat exchanger 22 is provided at that end thereof at which cooling fluid is fed in, i.e. at the end thereof to which the downstream end of the sixth rubber hose member 21 is connected. Thus, in the second heat exchanger 22 as in the first heat exchanger 8, during operation of the lubricating oil cooling system according to the preferred embodiment of the present invention, the directions of the flows of cooling fluid and of lubricating oil are opposite with the reason for this again being explained later.

Now, during operation of the vehicle incorporating this cooling system, the flow of cooling fluid is as outlined above, according to the propelling action of the cooling fluid pump 25: cooling fluid which has been heated up in the cooling fluid jacket 3 is expelled from the cooling fluid outlet 3*a* thereof, is driven through the first cooling fluid passage construction A including the cooling fluid passage of the first heat exchanger 8 (consisting of the parallel combination of the inner cylindrical space 46 and the hollow cylindrical shaped space 45) through which it flows in the right to left direction in FIG. 2 towards the radiator 12 at the front of the vehicle, passes through said radiator 12 while being cooled therein, is sucked through the second cooling fluid passage construction B including the cooling fluid passage of the second heat exchanger 22 through which it flows in the right to left direction in FIG. 2 towards the internal combustion engine 1 at the rear of the vehicle, and is sucked into the cooling fluid inlet 3*b* of the temperature sensitive valve 24, to be then returned to the cooling fluid jacket 3. Meanwhile, if the revolution speed of the internal combustion engine 1 is high enough to cause the lubricating oil pump 28 to generate sufficient lubricating oil pressure to cause a flow of lubricating oil to be vented by the first relief valve 31 to the relief lubricating oil conduit 34 (which is considered, in this preferred embodiment, to be the circumstance in which danger arises of overheating of the lubricating oil of the internal combustion engine 1), then this vented lubricating oil is supplied via the conduit 34 and the lubricating oil inlet mounting pipe member 49 and the lubricating oil inlet member 43 to the lubricating oil passage of the first heat exchanger 8 consisting of the hollow cylindrical shaped space 47, which is in close and heat exchanging relationship with the aforesaid cooling fluid passage of said first heat exchanger 8. After being cooled by exchanging some of its heat with the cooling fluid flowing through said cooling fluid passage of said first heat exchanger 8 (said cooling fluid being at a generally lower temperature than the lubricating oil, although being somewhat heated up), this cooled lubricating oil then is drained from said lubricating oil passage of said first heat exchanger 8 via the lubricating oil outlet member 44 and the lubricating oil outlet mounting pipe member 50 and the conduit 51, to be returned to the lubricating oil pan 26 of the internal combustion engine 1.

Meanwhile, similarly, if the revolution speed of the transaxle device 2 is high enough to cause the lubricating oil pump 53 to generate sufficient lubricating oil pressure to cause a flow of lubricating oil to be vented by the second relief valve 56 to the relief lubricating oil conduit 59 (which is considered, in this preferred embodiment, to be the circumstance in which danger arises of overheating of the lubricating oil of the transaxle device 2), then this vented lubricating oil is supplied via the conduit 59 to the lubricating oil passage of the second heat exchanger 22, which is in close and heat exchanging relationship with the aforesaid cooling fluid passage of said second heat exchanger 22. After being cooled by exchanging some of its heat with the cooling fluid flowing through said cooling fluid passage of said second heat exchanger 22 (said cooling fluid being at a much lower temperature than the lubricating oil, having been cooled in the radiator 12), this cooled lubricating oil then is drained from said lubricating oil passage of said second heat exchanger 22 via the conduit 60, to be returned to the lubricating oil pan 52 of the transaxle device 2.

Now, the advantages of this construction according to the present invention are as follows. The provision of the first heat exchanger 8 directly in the path of the cooling fluid which is passing between the internal combustion engine 1 and the radiator 12, as opposed to any more complicated construction, makes it possible to effectively cool the lubricating oil of the internal combustion engine 1 by the first heat exchanger 8 by using the flow of the cooling fluid of the internal combustion engine 1 which is anyway passing through the cooling fluid flow conducting means A incorporating said first heat exchanger 8 in order to be circulated through the radiator 12. Thereby the length of the cooling fluid flow conducting means A is not required to be particularly extended to any more than its already necessarily rather long length in order to fit the first heat exchanger 8 to the vehicle, thus avoiding that flow resistance of the cooling fluid conduits between the internal combustion engine 1 and the radiator 12 of the vehicle should become unduly high, and avoiding that problems should arise due thereto with regard to circulation of the cooling fluid of the internal combustion engine 1, while also minimizing complication, weight, and number of parts. The particular advantage of making the cooling fluid passage of the first heat exchanger 8 be a part of the part A of the cooling fluid flow conducting means between the internal combustion engine 1 and the radiator 12 which conducts a flow of cooling fluid from said cooling fluid jacket 3 of said internal combustion engine 1 towards said radiator 12 is that, according to such a structure, the heat picked up by the cooling fluid which has cooled the lubricating oil in the first heat exchanger 8 is then dissipated in the radiator 12 and is not undesirably returned to the internal combustion engine 1. This ensures that the temperature of the cooling fluid flowing through the cooling fluid jacket 3 of the internal combustion engine 1 is kept at a proper level; i.e., the cooling performance of the internal combustion engine 1 is not impaired by the functioning of the first heat exchanger 8. By arranging the direction of fluid flow through the cooling fluid passage of the first heat exchanger 8 to be generally opposite to the direction of fluid flow through the lubricating oil passage of said first heat exchanger 8, the effectiveness of heat exchange between this cooling fluid flowing in the cooling fluid passage of the first heat exchanger 8 and the lubricating oil flowing in the lubricating oil passage thereof is maximized.

Further, by making the first heat exchanger 8 with its cooling fluid passage and its lubricating oil passage being coaxial cylinders, the lubricating oil passage being radially sandwiched between two cooling fluid passages and the lubricating oil passage being traversed by axially and radially extending fins connected at the opposite radial ends thereof with the cylinders which define the outside and inside cooling fluid passages, a high capacity of heat interchange portion can be provided between the cooling fluid passage and the lubricating oil passage, with minimum increase of flow resistance. Now, by feeding lubricating oil to the first heat exchanger 8 from the relief side of the first relief valve 31, it is ensured that engine lubricating oil is only fed to said first heat exchanger 8 to be cooled in circumstances in which the internal combustion engine 1 is rotating quickly so that the lubricating oil pump 28 thereof is delivering a high output pressure so as to cause relief lubricating oil to be supplied by said relief valve 31, and, since these are the type of circumstances in which there is a strong risk of the lubricating oil of the internal combustion engine 1 overheating, this method of operation provides cooling for the lubricating oil of the internal combustion engine 1 just when it is required. Further, since only the relief or blowoff lubricating oil is cooled, the operation of cooling the lubricating oil has no substantial effect on the lubricating oil pressure of the internal combustion engine 1 either upwards or downwards, which is appropriate in view of the desirability of restricting fluctuations of the lubricating oil pressure of the internal combustion engine 1. By the provision of the second relief valve 36, as previously explained a backup relief function is assured for preventing the lubricating oil pressure of the internal combustion engine 1 rising above its set threshold pressure value. The provision of the second heat exchanger 22 for cooling the lubricating oil of the transaxle device 2 in a similar manner to the way the engine lubricating oil is cooled is effective for restricting rise in the temperature of said transmission lubricating oil. In this case, although the cooling fluid passage of said second heat exchanger 22 is a part of the part B of the cooling fluid flow conducting means which conducts cooling fluid from the radiator 12 towards the cooling fluid jacket 3 of the internal combustion engine 1, this will not cause any problem with regard to heating of the cooling fluid flowing into said cooling fluid jacket 3 of the internal combustion engine 1, because typically the amount of heat required to be dissipated from the lubricating oil of the transaxle device 2 is relatively small.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. A cooling system for lubricating oil of an internal combustion engine of a vehicle having a passenger compartment; a liquid cooled internal combustion engine mounted at least partly behind said passenger compartment with regard to a forward moving direction of said vehicle, a cooling fluid jacket for circulation of cooling fluid therethrough for cooling said internal combustion engine; a radiator for cooling the cooling fluid and which is mounted in front of said passenger compartment with regard to the forward moving direction of said vehicle; a first cooling fluid passage construction for conducting flow of cooling fluid from said cooling fluid jacket to said radiator; a second cooling fluid passage construction for conducting flow of cooling fluid from said radiator to said cooling fluid jacket; and means for circulating cooling fluid through a circuit including said cooling fluid jacket, said first cooling fluid passage construction, said radiator and said second cooling fluid passage construction being arranged in series in such order;

said cooling system comprising:

a heat exchanger formed with a cooling fluid passage and a lubricating oil passage arranged to exchange heat therebetween; and means for circulating lubricating oil of said internal combustion engine through said lubricating oil passage of said heat exchanger;

said cooling fluid passage of said heat exchanger being a part of said first cooling fluid passage construction.

2. A lubricating oil cooling system according to claim 1, wherein the direction of the cooling fluid flow through said cooling fluid passage of said heat exchanger is generally opposite to the direction of the oil flow through said lubricating oil passage of said heat exchanger.

3. A lubricating oil cooling system according to claim 1, wherein said heat exchanger is constructed with said cooling fluid passage and said lubricating oil passage being coaxial cylinders one inside the other.

4. A lubricating oil cooling system according to claim 1, wherein said heat exchanger is constructed with a first cooling fluid passage, said lubricating oil passage, and a second cooling fluid passage, all of said passages being coaxial cylinders, said first cooling fluid passage and said second cooling fluid passage annularly sandwiching said lubricating oil passage therebetween and being connected together at opposite axial ends thereof to provide said cooling fluid passage of said heat exchanger.

5. A lubricating oil cooling system according to claim 1, wherein said means for circulating lubricating oil further comprises a lubricating oil pump and a relief valve which feeds lubricating oil to said lubricating oil passage of said heat exchanger when the pressure delivered by said pump becomes greater than a predetermined pressure value.

6. A lubricating oil cooling system according to claim 5, wherein said internal combustion engine comprises a second relief valve which vents lubricating oil not to supply lubricating oil towards said lubricating oil passage of said heat exchanger when the pressure delivered by said pump becomes greater than a threshold pressure value which is substantially higher than said predetermined pressure value.

7. A lubricating oil cooling system according to claim 1, said vehicle further comprising a transmission, further comprising a cooling system for lubricating oil of said transmission, comprising:

a second heat exchanger formed with a cooling fluid passage and a lubricating oil passage arranged to exchange heat therebetween,; and means for circulating lubricating oil of said transmission through said lubricating oil passage of said second heat exchanger;

said cooling fluid passage of said second heat exchanger being a part of said cooling fluid flow conducting means.

8. A lubricating oil cooling system according to claim 7, wherein said means for circulating lubricating oil through said lubricating oil passage of said second heat exchanger further comprises a second lubricating oil pump and a relief valve which feeds lubricating oil for said transmission to said lubricating oil passage of said second heat exchanger when the pressure delivered by said second pump becomes greater than a predetermined pressure value.

* * * * *